US005715908A

United States Patent [19]

Sager

[11] Patent Number: 5,715,908

[45] Date of Patent: Feb. 10, 1998

[54] LADDER EXTENSION

[76] Inventor: Scott E. Sager, 14 Elizabeth St., Chappaqua, N.Y. 10514

[21] Appl. No.: 754,199

[22] Filed: Nov. 20, 1996

Related U.S. Application Data

[63] Continuation of Ser. No. 370,259, Jan. 9, 1995, abandoned.

[51] Int. Cl.[6] ..... E06C 7/00

[52] U.S. Cl. ..... 182/172; 182/111

[58] Field of Search ..... 182/172, 107–111

[56] References Cited

U.S. PATENT DOCUMENTS

| | | | |
|---|---|---|---|
| 495,920 | 4/1893 | Strohm | 182/172 X |
| 3,012,628 | 12/1961 | Zumbaum | 182/172 |
| 3,395,776 | 8/1968 | Russell | 182/172 X |
| 3,508,628 | 4/1970 | Conrad | 182/172 |
| 4,175,641 | 11/1979 | Reyes | 182/108 X |
| 4,412,599 | 11/1983 | McCrudden | 182/214 X |
| 4,519,477 | 5/1985 | Ralston | 182/172 X |
| 5,423,397 | 6/1995 | Boughner | 182/172 X |

FOREIGN PATENT DOCUMENTS

| | | | |
|---|---|---|---|
| 2440462 | 7/1980 | France | 182/116 |
| 2250312 | 6/1992 | United Kingdom | 182/107 |

*Primary Examiner*—Alvin C. Chin-Shue

*Attorney, Agent, or Firm*—Watson Cole Stevens Davis, P.L.L.C.

[57] ABSTRACT

A safety extension attached to the two ladder stiles and extending outwardly therefrom. Each extension is attached at two spaced locations along a ladder stile and terminates outwardly and downwardly in a V-shaped junction to which a stabilizing foot is attached.

8 Claims, 3 Drawing Sheets

LADDER EXTENSION

This application is a continuation of application Ser. No. 08/370,259, filed Jan. 9, 1995, abandoned.

The present invention relates generally to the structure of ladders. More specifically, it refers to such structures which, in addition to ladder feet, employ other means to stabilize a ladder.

It is well-known that ladders, and in particular extension ladders, are basically unstable. Even in the circumstance when the feet of the ladder are placed against a firm and level support or base, the longer the ladder the less stable the ladder becomes. Because ladders are normally of the same width at the top and bottom, basic physics dictates that when one wishes to make a very tall object stable, the base should be wider than the top and not of the same width as a ladder at the top, especially if a large portion of the weight of the ladder is distributed evenly through-out its length. As a consequence, a ladder would be far more stable were it wider at its base then at its top, and were the weight of the ladder concentrated near its base. Unfortunately, this is simply not the case with existing ladders.

Ladder instability has been widely recognized by those of skill in the art, and a number of patents disclose inventions designed to meet deficiencies of extension ladders for lack of stability.

An example of the prior art in this field is U.S. Pat. No. 4,147,231 to Chantler et al. Other prior art that exemplifies the present state of the art include U.S. Pat. No. 4,244,446 to Mair, and U.S. Pat. No. 4,632,220 to Murrell. In all of these prior patents a ladder is outfitted with what are referred to as outriggers or shoe members that serve as supports, in addition to the feet that form a part of all ladders. The supports extends from the ladder stiles of which they are a part, toward the base surface on which the ladder rests. Yet it will be apparent that many of these prior art ladder supports are deficient. Preliminarily, such prior ladder stabilizers are attached to their ladder. This makes the ladder heavier and more cumbersome to carry and to erect. In addition, when the ladder breaks or becomes inutile, the ladder extension must also be discarded, since the extension or outrigger is part of the ladder. Also, with regard to such supports, those that are fixed to the ladder stiles are generally of equal length. As a consequence, when the ladder stabilizer is attached to the ladder stiles in a fixed location, on uneven ground downhill pressure on the ladder may cause the foot on the higher side to "walk" inwardly, which then stabilizes the ladder at a dangerous, non-perpendicular angle.

Other types of ladder extensions, such as those identified in U.S. Pat. Nos. 4,872,529 and 4,899,849, are adjustable with telescoping tubular pole members. It will be immediately apparent that such telescoping members are not as strong as a solid piece of metal, for example, tubular steel, and that the rubber plugs inside the tubular poles will wear and slip with use. Further the poles, themselves, can kink at any time, rendering them useless.

It will thus be apparent that there exists a need for a ladder extension that will be simple and safe in design, can be economically manufactured to result in a reasonable sales price, and can readily be adjusted to support a ladder over a wide variety of terrains in such a manner that supports extending outwardly from both stiles reach equally and to their full extent, so that a full measure of support is provided in either direction regardless of the level of the terrain. The structure of the present invention has been designed with these features and advantages in view. As a consequence, the structure of the present invention has no folding or telescoping parts that sacrifice strength and stability in the name of storage convenience. Further, there is nothing to slip or wear out and the present device is useful regardless of the terrain and supports a ladder equally and outwardly of both stiles.

SUMMARY OF THE INVENTION

In its basic form, the present invention comprises a safety extension for a ladder having opposed, parallel stiles adapted to support a plurality of spaced rungs between them. The stiles conventionally terminate in feet for supporting the ladder against a base surface, e.g., the ground. Each safety extension according to the present invention comprises two elongated struts joined at one of their respective ends to form a V-shaped juncture between them from which the free ends of the struts extend. A clamp is attached to each of the struts at its free end, the clamps being dimensioned to enable them to contact and grasp one of the stiles so that the struts are clamped to said stile at spaced locations along the length of the stile. Finally, means for contacting the base surface is located substantially at the V-shaped juncture of the struts, and thereby provides an area of support for the ladder against the base surface in addition to that provided by the feet of the ladder.

In normal use two safety extensions will be provided, each having the same structure as outlined hereinbefore, and each being attached to a stile by means of clamps attached to the free ends of each strut. As so constructed, and particularly where the ground or the base surface is uneven, i.e., lower on one side of the ladder than on the other, the clamping means of the extension on the down-slope side will be attached to the stile on that side at lower positions of attachment than on the upper-slope stile. In this manner the outward reach of the ladder extensions will be the same on either side of the ladder and the ladder will be equally supported regardless of the slope of the base surface on which it is supported.

In other features, the stabilizing means attached to the V-shaped angle at which the two struts of an extension are joined constitutes a foot for contacting the base surface with at least as much in area as the stile foot. The stabilizing means may include a substantially planar pad for contact with the base surface. Also, in a preferred embodiment, the pad or other stabilizing surface is attached to the V-shaped juncture of two struts by a clevis type of arrangement, wherein two ears extend upwardly from the pad, and have aligned orifices through which a pin extends. An element fixed to the juncture is mounted on the pin, permitting rotation of the pad relative to the strut juncture in case the surface on which the pad rest is uneven.

With respect to the structure by means of which the free ends of the struts are removably clamped to the ladder stiles, such structure may include a U-shaped clamp housing adapted to fit over and grasp side walls of the strut. The U-shaped housing is formed from two brackets held in U-shape by a screw that extends through a slot in at least one of the L-shaped elements. At the end of the screw within the U-shaped housing, a gripper plate is mounted so that when a handle at the other end of the screw is rotated, the gripper plate is forced against the side of the ladder stile, thus maintaining the gripper plate, clamp and strut fixed to one of the brackets in place on the ladder stile. After the ladder has been used, it is a simple matter to counterrotate the screw by its handle and remove the extension from the ladder.

These and other features and advantages of my invention will become more apparent when taken in connection with a detailed description of a preferred embodiment thereof, in which FIG. 1 is a front elevational view showing ladder stabilizers according to my invention mounted in place on a ladder located on a flat surface;

DETAILED DESCRIPTION

Figure 1:
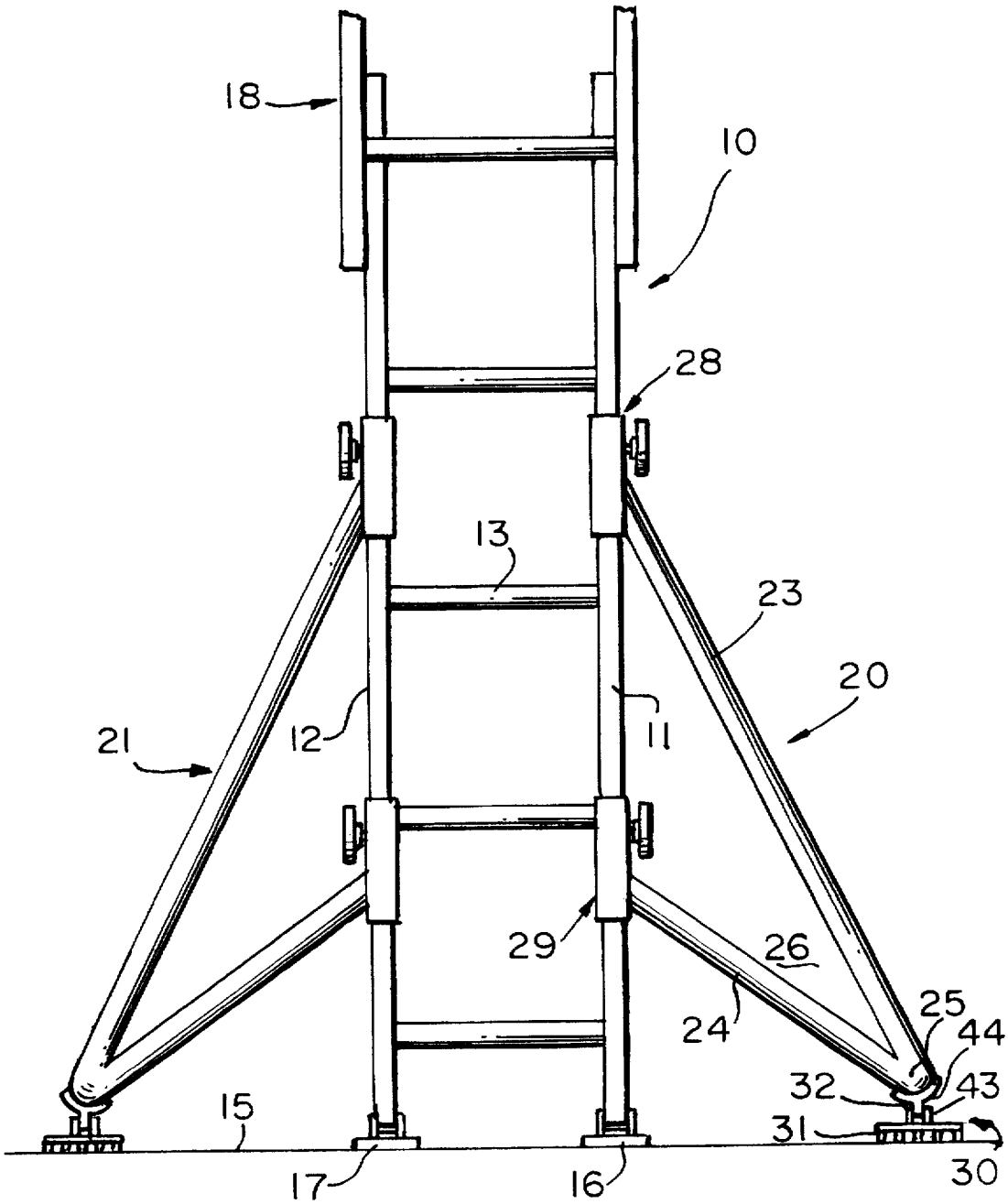

In FIG. 1 a conventional ladder 10 is shown in such a position that it is resting against the side of a structure (not shown). The ladder 10 has two stiles 11 and 12 separated by rungs 13. At its lower most extension the ladder rests on a base surface, such as the ground 15 and is maintained thereon by feet 16 and 17. Its uppermost end a portion of a ladder extension 18 is shown.

As generally illustrated in FIG. 1, ladder stabilizing extensions 20 and 21 are indicated by arrows at either side of the ladder 10. The structures of the stabilizing extensions are duplicated, not only structurally but with respect to their position in FIG. 1, since the base surface 15 is level. Thus, stabilizing extension 20 consists of two elongated struts 23 and 24 joined in permanent relationship at a juncture 25. As will be seen, upper strut 23 is of greater length than lower strut 24 and is fixed to it at juncture 25 to form a generally V-shaped structure. As presently advised, an interior angle 26 formed by the V is preferably about 25 degrees. Of course, the greater the angle of the V-shaped juncture, the greater will be the distance between the ends of struts 23 and 24 at their free ends and, as a consequence, the greater will be the linear separation between the free ends of struts 23 and 24 at locations where they are adjacent to the stile 11.

At their upper ends struts 23 and 24 are attached, preferably fixedly, to clamps indicated generally by arrows 28 and 29. The structure of such clamps will be more fully described hereinafter with respect to FIGS. 3 and 4.

Just below the V-shaped juncture 25 is means for contacting base surface 15. The purpose of such means is to provide an area of support for the ladder against the base surface in addition to the support provided by ladder feet 16 and 17. Such support means 30 includes a foot 31 which is an actual contact with the ground, upstanding ears 32 having axially aligned orifices therethrough, and a pin 43 rotatably mounted in such aligned orifices. A juncture support 44 is affixed to the base of the V-shaped juncture 25 and is mounted on the pin 43 for rotation therewith. In accordance with the best mode of the present invention, the juncture support 44 is mounted in fixed relation to the pin 43 within the aligned orifices of the extension support 30. In this way as pin 43 rotates, juncture support 44 and the V-shaped juncture or elbow 25 also rotate. Alternatively, pin 43 can be fixedly mounted in ears 32 and support 44 rotate about pin 43, or the support 44 can be rotatable and the pin 43 rotatable in ears 32 as well.

Figure 2:
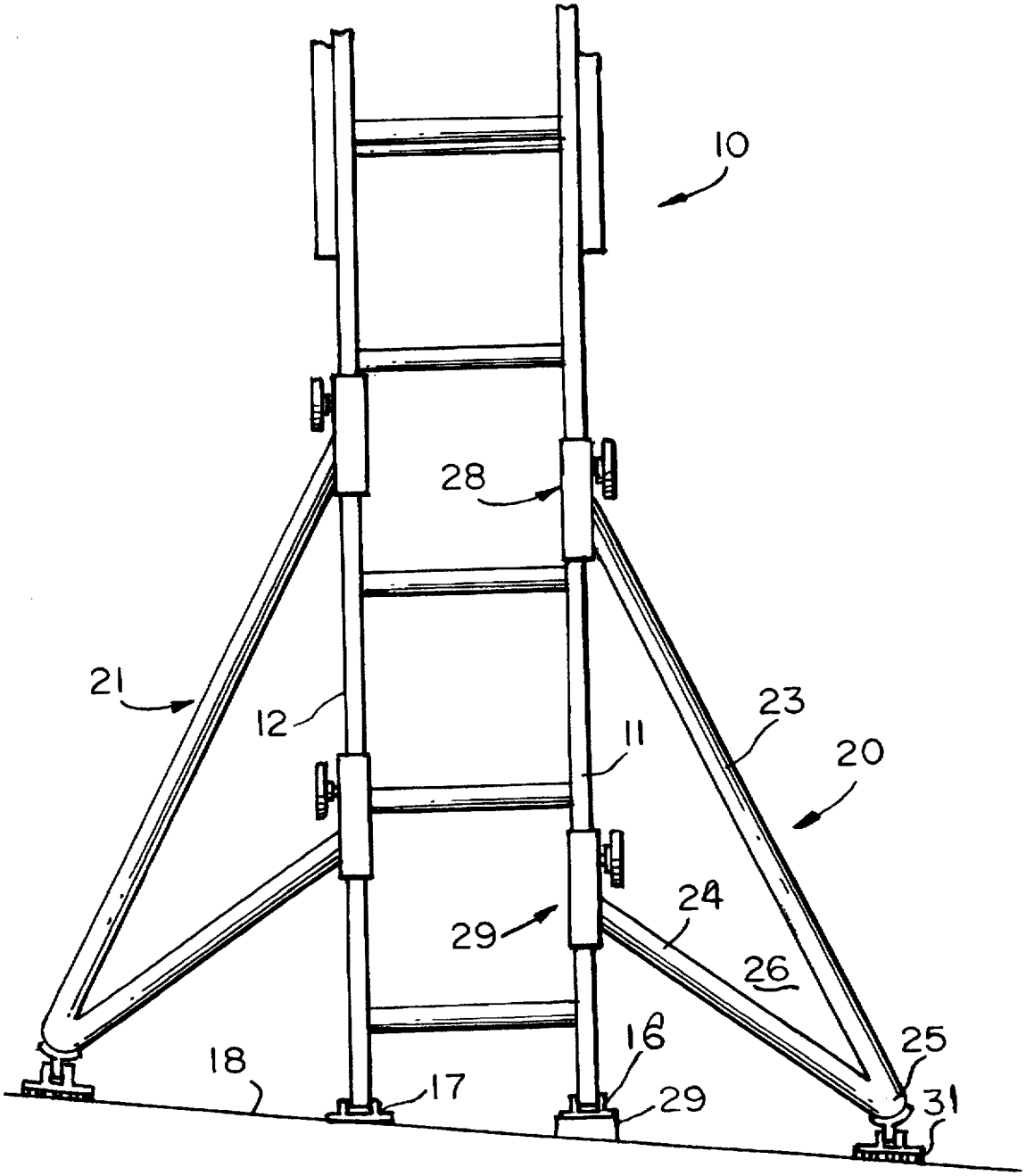
FIG. 2 is a front elevational view similar to that of FIG. 1, except that the ladder and extensions or stabilizers are located on sloping terrain.

The present invention has particular applicability when, as is often the case, the ladder rests on uneven ground. Such circumstance is illustrated in FIG. 2. As will there be seen, while in FIG. 1 extensions 20 and 21 were affixed by clamps to the ladder 10 at substantially equal locations along the ladder stiles 11 and 12, extensions 20 and 21 are now attached at differing positions in FIG. 2. There the base surface 18 slopes downwardly from left to right. In such circumstance ladder 10 thus has a chock 29 placed under its down-slope foot 16, and up-slope ladder foot 17 remains substantially without additional support.

In order to compensate for the slope of base surface 18, clamps 28 and 29 are illustrated in FIG. 2 as attached to stile 11 at locations that are lower along stile 11 than are corresponding clamps of ladder extension 21 attached to stile 12. Because of such lower attachment on stile 11, V-shaped juncture 25 is now in a lower position so that enlarged foot 31 is in substantially flat and broad contact with the base surface at its lower level. Because the angle 26 of the V-shaped juncture 25 remains the same, the struts 23 and 24 being permanently joined at that juncture, there is no diminution in the strength of ladder support 20 of its new position. Yet, as will be apparent, it provides great additional support to the ladder 10, even on sloping ground.

Figure 4:
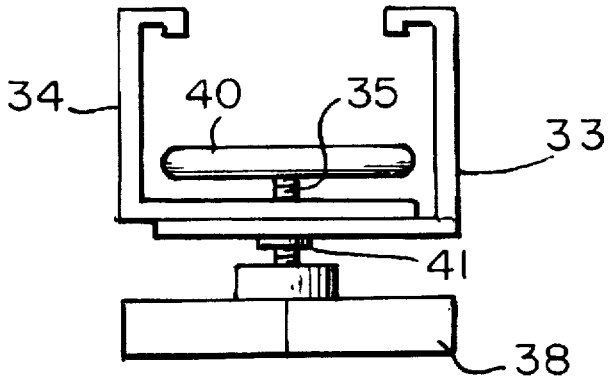
FIG. 4 is a top plan view of an assembled clamp according to FIG. 3 of my invention.
Figure 3:
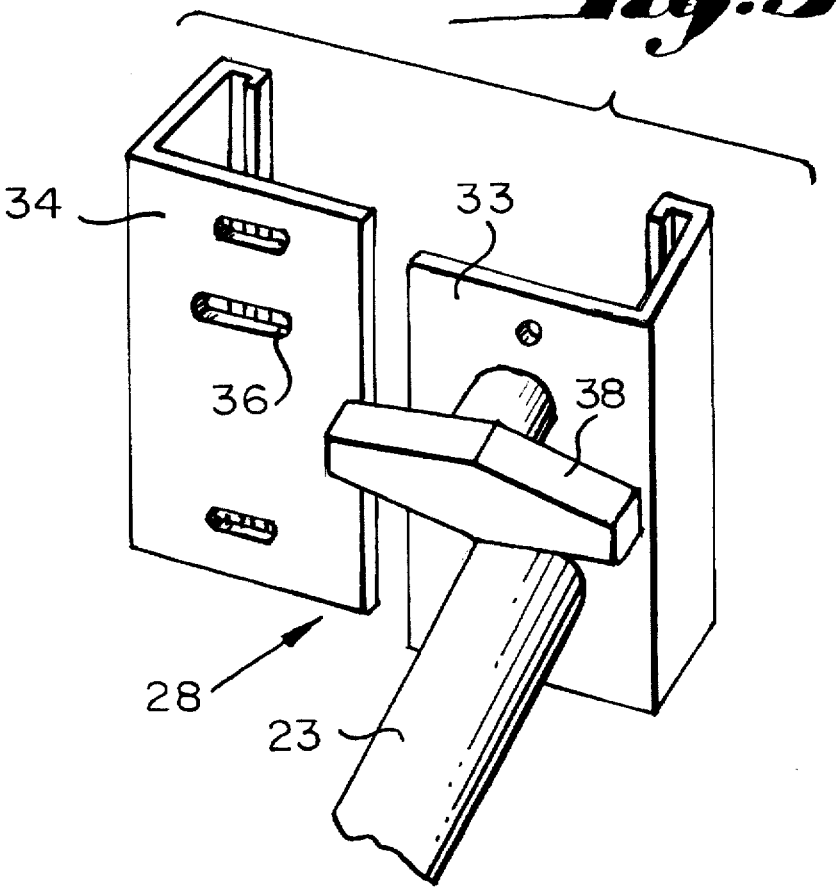
FIG. 3 is a perspective view of a clamp suitable for use with the present invention, with parts thereof spaced apart.

The structure of a preferred embodiment of the clamp of the present invention will now be described with reference to FIGS. 3 and 4. For the purpose of illustration, in FIG. 3 clamp 28 is illustrated with strut 23 affixed to one part of the clamp. However, the structure will be the same for all the other clamps used to hold the ladder extensions 20 and 21 to their respective stiles 11 and 12. With reference to FIGS. 3 and 4, strut 23 is fixed to the face of L-shaped bracket 33 which is then placed in conjunction with another L-shaped bracket 34 as shown in FIG. As so associated, clamp part 33 overlies the face of clamp part 34 so that a screw 35 extends through slot 36 in part 34 as well as through an appropriate orifice in part 33. Screw 35 terminates at one end in knob 38. It terminates inwardly of the clamp in a gripper plate 40. As will be apparent, because of the use of stud 41 between the knob 38 and clamp bracket 33, rotation of the knob 38 in a clockwise direction will result in the screw 35 being rotated clockwise to move inwardly of the brackets 33 and 34. At the same time the gripper plate 40 attached to the inner extension of screw 35 will be moved inwardly. Thus, clockwise rotation of knob 38 forces grip plate 40 against stile 11 of the ladder 10 and rotation is maintained until that grip plate is in a position to releasably hold the ladder extension 20 in position, e.g., the position shown in FIGS. 1 or 2. In that instance clamp 29 will also be affixed to stile 11 in a similar manner, and ladder extension 21 will be clamped to stile 12 by the same devices.

As has been disclosed in this preferred embodiment of my invention, the ladder extensions are readily detachable from the ladder with which they are to be used. As a consequence, they carry an distinct advantage regarding previous ladder stabilizers that are permanently attached to a ladder, making the ladder heavier and more cumbersome to carry and put in place. Because my ladder extension is not permanently secured to the ladder, it can easily be removed for storage and adjusted in seconds as the terrain on which the ladder is used varies. For storing convenience, my ladder extensions can simply be detached from the ladder and stored separately and conveniently. This is a distinct advantage over ladder extensions that are permanently attached to the ladder, which often require folding or telescoping parts that sacrifice strength and stability in the name of storage convenience. Every part that is critical to the structural stability of the present invention is welded solidly in place, e.g., the V-shaped juncture 25, so that there are no joints whose structural stability is mitigated because of the need to vary the angle of the joint to accommodate different ground slopes or for the purpose of storage.

While my invention has been described with reference to a specific embodiment thereof, which is presently deemed to be the best mode, it will be apparent to those of skill in this art that certain modifications and alterations of that preferred embodiment may be found obvious. As to all such alterations and modifications, it is desired that they be included within the purview of the present invention, which is to be limited only by the scope, including equivalents, of the following, appended claims.

I claim:

1. The combination of a safety extension and a ladder having opposed, parallel, longitudinally extending stiles supporting a plurality of spaced rungs between them, said stiles terminating in feet for supporting said ladder against a base surface, comprising:

two elongated struts fixed to each other against relative movement at one of their respective ends to form a juncture between them from which the free ends of said struts extend, each of said struts forming an acute angle with said base surface at said juncture, a clamp attached to each of said struts at its free end, said clamps being dimensioned to contact and detachably grasp one of said stiles so that said struts are clamped to said stile at spaced locations along the length thereof, and stabilizing means located substantially at said juncture of said struts, said stabilizing means comprising a pivotally attached foot for contacting said base surface to provide an area of support for said ladder against said base surface in addition to said ladder feet, said stabilizing means and said ladder feet being located in substantially the same horizontal plane when said base surface is substantially horizontal.

2. The combination of a safety extension and a ladder as claimed in claim 1, in which said clamp includes a housing mounted on said stile and having a screw carrying a gripper plate positioned so that upon rotation of said screw, said gripper plate is brought into engagement with said stile to hold said strut against said stile.

3. The combination of a safety extension and a ladder as claimed in claim 2, in which said housing is formed from two interengaging brackets that can be expanded to enable said clamp to fit about said stile and contracted to bring said housing into stile-clamping position.

4. The combination of a safety extension and a ladder as claimed in claim 3, in which said screw extends through a horizontal slot in at least one of said housing brackets, so that said brackets may be moved between expanded and contracted positions with said screw extending through said slot.

5. The combination claimed in claim 1, in which said juncture of said struts is V-shaped and defines an angle of about 25°.

6. The combination claimed in claim 1, in which said foot attached to said stabilizing means has an area of contact with said base surface at least as large as said stile foot.

7. The combination claimed in claim 1, in which said stabilizing means foot includes a substantially planar pad for contacting said base surface.

8. The combination claimed in claim 1, in which said stabilizing means foot further comprises a clevis having upstanding ears supporting a pin therethrough, said pin being fixed with respect to said ears, and a knob mounted on said pin for rotation with respect to said pin, said knob being fixed to said juncture to permit rotational movement of said juncture in an arc about said pin.

* * * * *